United States Patent [19]

Tremblay

[11] Patent Number: 4,723,631

[45] Date of Patent: Feb. 9, 1988

[54] FOLDABLE LADDER

[76] Inventor: Raymond Tremblay, 1101 Rachel Street, East Montreal, Canada, H2J 2J7

[21] Appl. No.: 908,385

[22] Filed: Sep. 17, 1986

[51] Int. Cl.[4] ..... E04C 1/383

[52] U.S. Cl. ..... 182/161; 182/106; 182/206; 182/228

[58] Field of Search ..... 182/156–162, 182/96, 95, 176, 124, 125, 106, 206, 228

[56] References Cited

U.S. PATENT DOCUMENTS

| | | | |
|---|---|---|---|
| 361,212 | 4/1887 | Dormitzer | 182/161 |
| 488,990 | 1/1893 | Dormitzer | 182/161 |
| 720,891 | 2/1903 | Hall | 182/156 |
| 1,198,739 | 9/1916 | Jachowski | 182/156 |
| 2,160,124 | 5/1939 | Cast . | |
| 2,280,691 | 3/1942 | Edelmann | 182/176 |
| 2,596,521 | 5/1952 | Bell . | |
| 3,381,775 | 5/1968 | Livers | 182/106 |
| 3,407,901 | 10/1968 | Brammer . | |
| 3,446,311 | 5/1969 | Alfie . | |

FOREIGN PATENT DOCUMENTS

| | | | |
|---|---|---|---|
| 1004195 | 1/1977 | Canada . | |
| 853054 | 10/1952 | Fed. Rep. of Germany | 182/161 |
| 806116 | 9/1936 | France | 182/161 |

*Primary Examiner*—Reinaldo P. Machado

[57] ABSTRACT

A ladder made of a rectangular main frame, spaced parallel rods interconnecting the two long side legs of the ladder, and step panels each pivotally mounted at its front corners to one rod for pivotal action within the ladder frame. A rigid link pivotally interconnects the rear corners of the step panels on each side thereof. Short lever arms also pivotally interconnect the rear portion of the side edges of the topmost step panel to the interior face of the respective side legs. Each short lever arm has a central longitudinal slot slidingly engaged by a pivot pin projecting from the frame side legs. Thus, lengthwise displacement of the link moves the step panels in between a horizontal operative position, in which the pivot pin abuts against the outer edge of the lever arm longitudinal slot farthest from the topmost step panel, and a ladder-storage position in which all elements of the ladder are coplanar with its quadrangular frame and the pivot pin abuts against the inner edge of the lever arm longitudinal slot nearest from the topmost step panel. An inverse U-shaped frame may be hinged to the main frame upper portion to constitute a stepladder and is coplanar with the main frame when the stepladder is folded.

6 Claims, 20 Drawing Figures

FOLDABLE LADDER

FIELD OF THE INVENTION

The present invention relates to foldable ladders.

BACKGROUND OF THE INVENTION

Simple known ladders generally do not need to be foldable, since their successive step rods are already nested within the plane of the ladder main frame and, thus, are most compact.

Recent ladders tend to feature wider steps for increased comfort and safety of the users. These steps protrude from the plane of the main ladder frame and, thus, require a larger storage area for the ladder.

Folding mechanisms have been proposed in the art for pivoting the step panels of these latter ladders in between operative and inoperative (unobstrusive) conditions. Typical of these mechanisms is the parallelogram linkage assembly disclosed in Canadian Pat. No. 1,004,195, issued Jan. 25, 1977 to John A. Herwynen. The main disadvantage of this patent is that linkage elements still project outwardly the plane of the ladder main frame when in folded condition.

No solution has been found as yet to bring the linkage assembly within the plane of the main ladder frame when the latter is completely folded.

OBJECTS OF THE INVENTION

The gist of the invention is to provide a foldable ladder that will be most compact when closed.

Another object of the invention is that the above-noted ladder be sturdy in construction, light in weight and safe in use.

SUMMARY OF THE INVENTION

In accordance with the stated objects of the invention, there is disclosed a ladder comprising a main planar frame defining two tubular side legs, at least two step panels each defining a top flat surface and two opposite side edges, each of said step panels pivotally connected at its front corners by a first pivot member to the interior face of said side legs in lengthwisely-spaced fashion. The step panels are pivotable between the side legs of the frame, and the thickness of said step panels at the most equal to the diameter of said side legs. A pair of rigid links pivotally interconnect the rear corners of said step panels by second pivot members. Short retainer arms are pivoted to the upper ends of the links and have a lost motion connection with said side legs at points above the topmost step panels. The side legs, step panels and links form deformable parallelograms. The retainer arms retain the step panels in unfolded operative position, while the links abut the rods to maintain the step panels in folded inoperative position, wherein all the parts of the ladder are nested within said frame and coplanar therewith for storage of the ladder in a very shallow space.

DETAILED DESCRIPTION OF THE TWO PREFERRED EMBODIMENTS OF THE INVENTION

Figure 1:
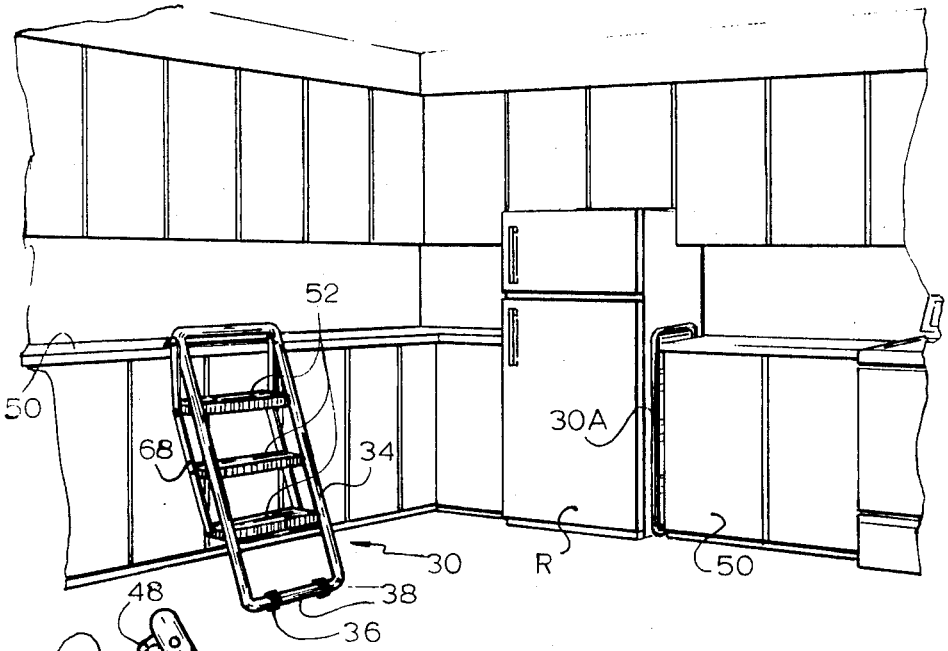
FIG. 1 is a fragmentary perspective view of a kitchen and showing one ladder according to a first embodiment of the invention in operative position bearing against the kitchen counter, and a second ladder in folded position and stored between the refrigerator and the kitchen counter.
Figure 2:
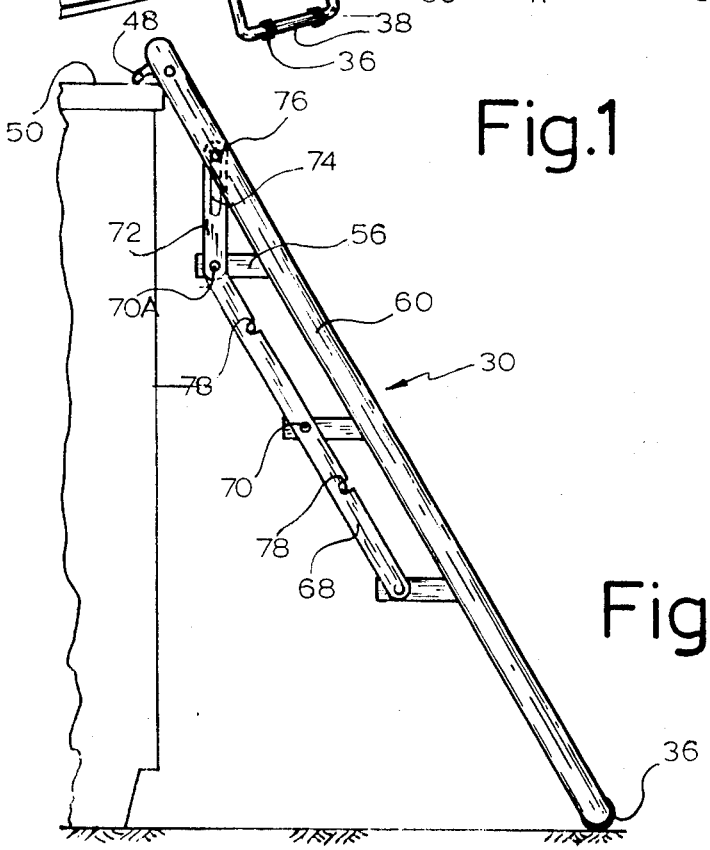
FIG. 2 is a fragmentary elevation of the kitchen counter and of the ladder in operative position.
Figure 3:
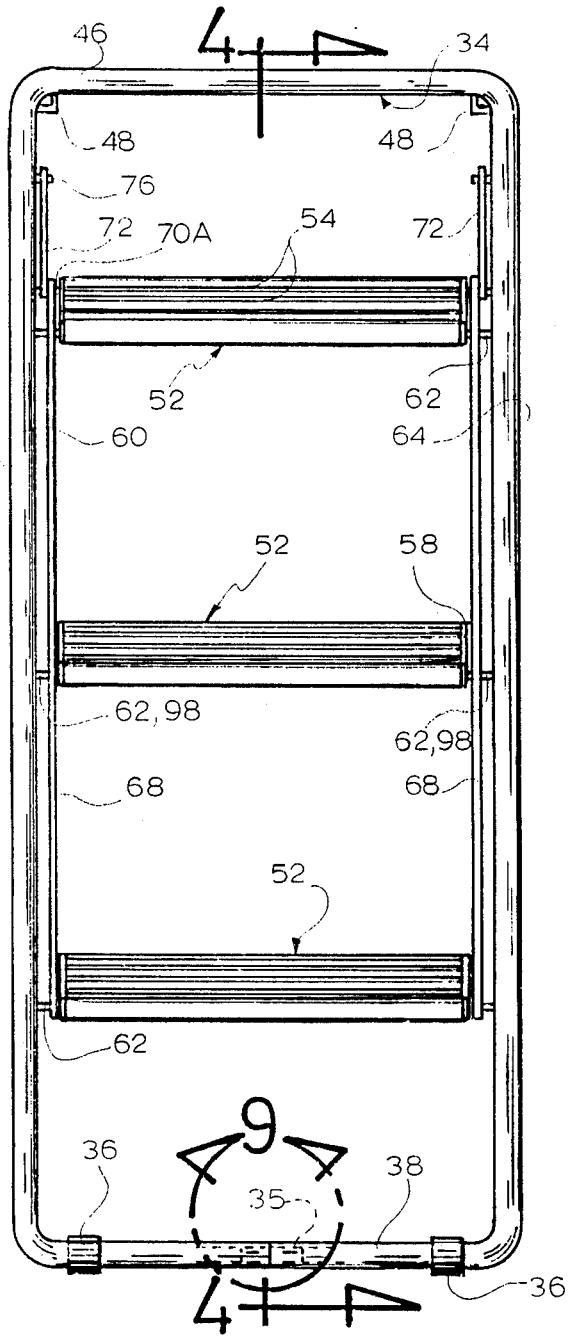
FIG. 3 is a front elevation view of the ladder of FIG. 1, in unfolded vertical position.
Figure 4:
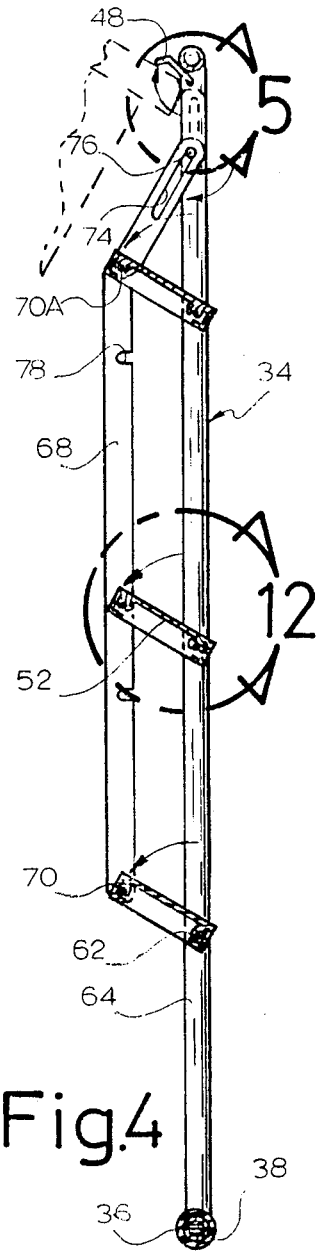
FIG. 4 is a section baken along line 4—4 of FIG. 3, with the adjacent broken portion of the kitchen counter in dotted lines.

A simple ladder 30 or a larger higher stepladder 32 can benefit from the features of the invention, as shown in the drawings and as will be explained below. In the ladder 30 illustrated in FIGS. 1 to 4, there is defined a main tubular frame 34, made of a single metallic alloy tube bent in a rectangle. Both ends of the frame tube 34 join at its bottom leg 38, and these tube ends are fixedly interconnected by a cylindrical stud 35 engaged therein and retained by diametrically-reduced portions 38' of the tube ends. Short elastomeric sleeves 36 surround the bottom leg 38 of the frame 34 to constitute anti-skid feet; however, it is envisioned that sleeves 36 be replaced by short arcuate strips 40, made also of elastomeric material, each fixedly secured to leg 38 by a fastener 42 engaging a cavity 44 in each strip 40 and through leg 38 to the side legs 60 of frame 34; adjacent its top leg 46 is pivoted a U-shaped hook rod 48, designed to rest against a supporting surface, such as the horizontal kitchen counter 50, illustrated in FIGS. 1–2, in the operative, inclined position of ladder 30. This hook rod 48 is not essential but is a safety feature to prevent slipping of the ladder 30. It will be described in greater detail hereinafter.

The heart of the invention lies in the way the steps 52 of the ladder 30 are foldably mounted to the frame 34. The three steps 52 of ladder 30 each consists of a rectangular, extruded, aluminum panel having on its top flat surface longitudinally-extending anti-skid ribs 54 and fitted with two opposite end plates 56, 58, which are mirror images of each other. Each end plate 56, 58 is pivotally connected to the inner face of one main leg 60 of frame 34 by a pivot rod 62, projecting from one side of plate 56 and extending lengthwise of and adjacent the front face of step 52 and through the corresponding end plate 58 and the other main leg 64 of frame 34, as will be detailed later.

A pivot rod 70 also extends lengthwise of step 52 adjacent its rear face, through end plates 56, 58, and makes a pivot connection at each end, with a straight link 68 of flat cross-sectional shape. To each end of the topmost rod 70A, is pivotally connected the lower end of a retaining arm 72 for pivotal movement about a plane parallel to and exteriorly of the link 68. Arm 72 includes, at its top end, a longitudinal slot 74, slidably engaged by a bolt 76 mounted through legs 60, 64, respectively, above the topmost step and retained by a lock cap 76A. A washer 77 preferably separates arm 72 from the adjacent frame leg 60 or 64.

Figure 5:
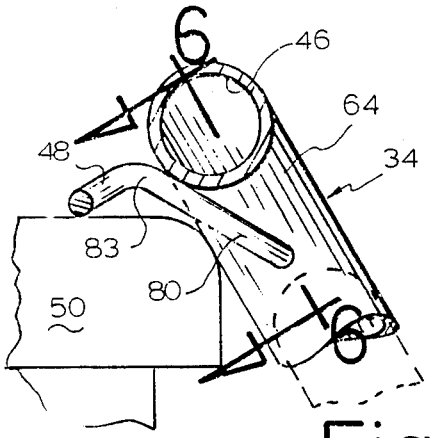
FIG. 5 is an enlarged, sectional view of part of the area circumscribed by circle 5 in FIG. 4, but with the kitchen counter portion in full lines.
Figure 7:
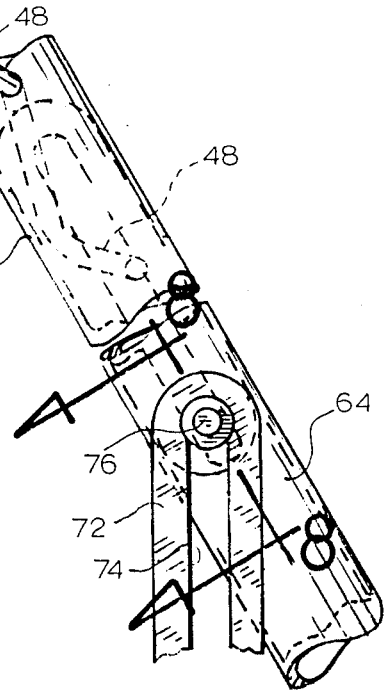
FIG. 7 is an enlarged view of another part of the area circumscribed by circle 5 in FIG. 4, relative to that of FIG. 5.
Figure 6:
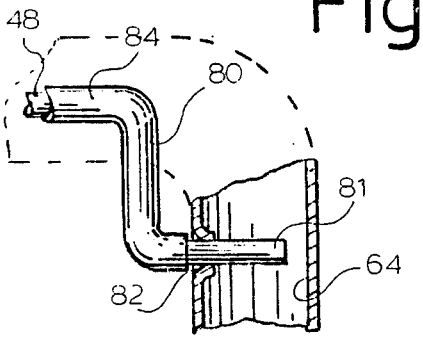
FIG. 6 is a section taken along line 6—6 of FIG. 5, but with a tubing portion of the ladder in dotted lines for clarity of the view.
Figure 8:
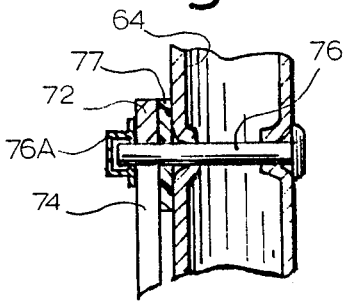
FIG. 8 is a section taken along line 8—8 of either of FIG. 7 or 16.
Figure 9:
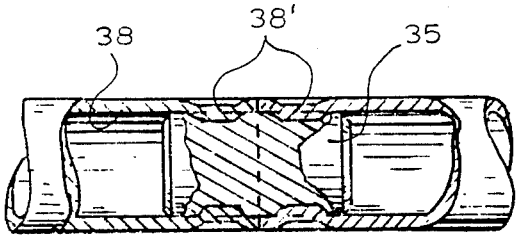
FIG. 9 is a partly-sectional side view on an enlarged scale of the area circumscribed by circle 9 in either of FIG. 3 or 16.
Figure 10:
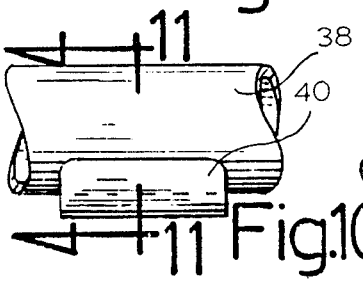
FIG. 10 is a fragmentary side elevation of the foot tubing of the ladder.
Figure 11:
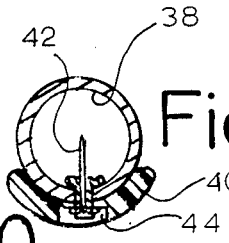
FIG. 11 is a cross-sectional view taken along line 11—11 of FIG. 10.
Figure 13:
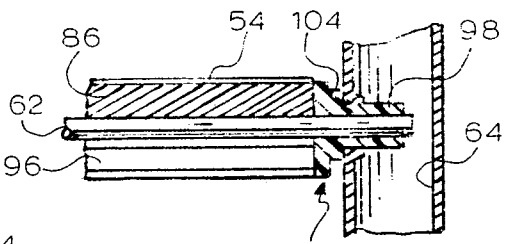
FIGS. 13 and 14 are sections taken along lines 13—13 and 14—14, respectively, of FIG. 12.
Figure 12:
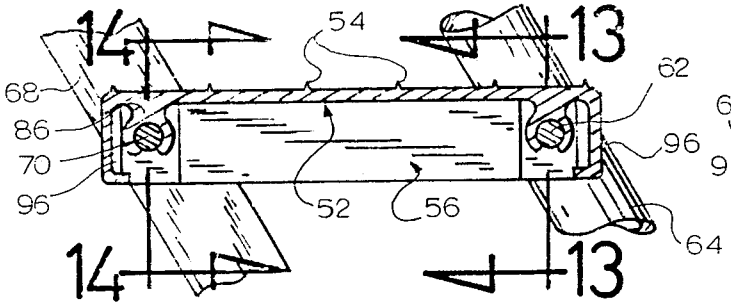
FIG. 12 is an enlarged view of the area circumscribed by circle 12 in FIG. 4 or alternately a section taken along line 12—12 of FIG. 16.
Figure 12:
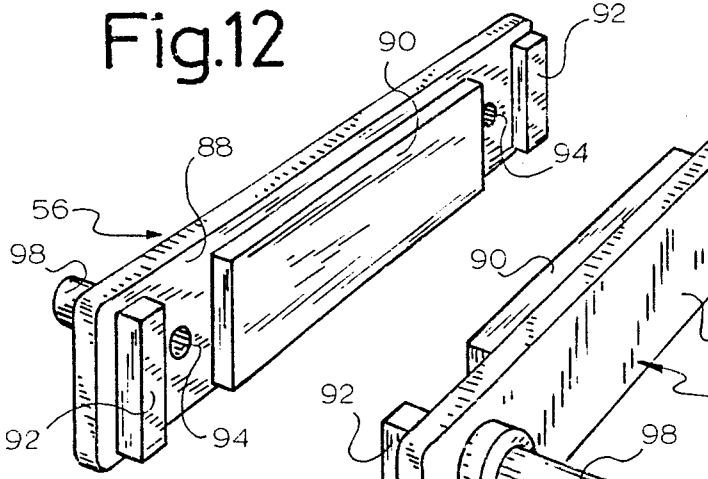
Figure 14:
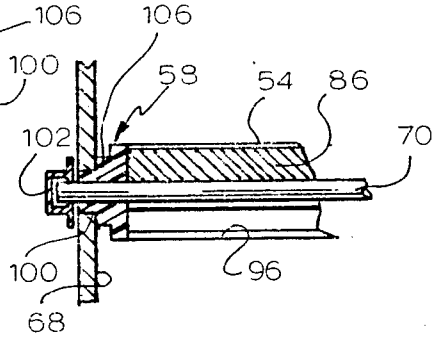
Figure 15:
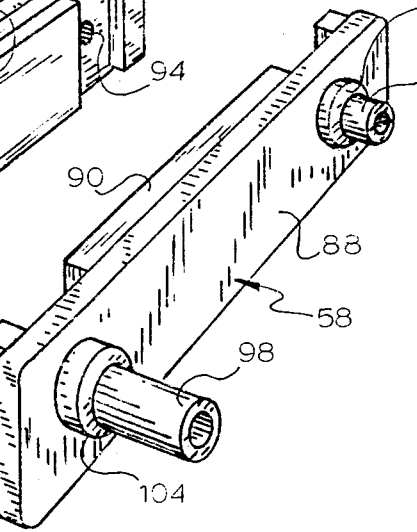
FIG. 15 is a perspective view of the two separate mounting plate assemblies fixed to the opposite ends of the steps of the embodiments of ladders shown in either of FIG. 1 or 16.
Figure 16:
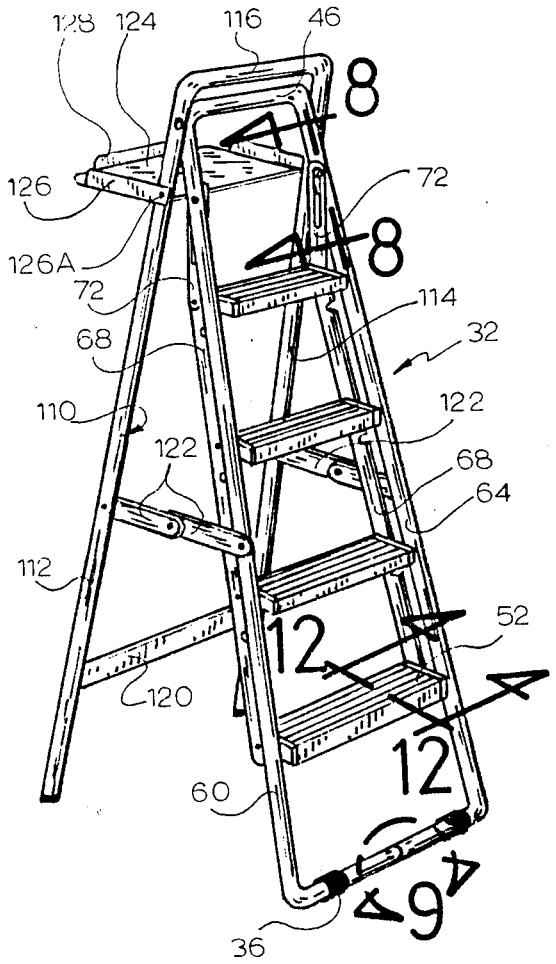
FIG. 16 is a perspective view in elevation of a stepladder according to a second embodiment of the invention.

Links 68 form with steps 52 and frame 34 a deformable parallelogram linkage at both ends of steps 52. In the operative ladder condition shown in FIG. 2, the top surfaces of steps 52 are horizontal, frame 34 being properly inclined. Bolts 76 engage the topmost ends of slots 74 of retaining arms 72 which maintain the topmost step 52 in horizontal position. Pulling the rear face of anyone step 52 will pivot all the steps upwardly about frame legs 60, 64. The central longitudinal slot 74 of each retaining arm 72 should be long enough to allow all the steps 52 to become coplanar with and be nested within frame 34 in the folded inoperative position of steps 52. As clearly seen in FIG. 3, there is sufficient space between end plates 56,58 and the respective frame legs 60,64 to allow nesting of links 68 and retaining arms 72 therebetween. Two notches 78 are provided spacedly lengthwise of each link 68 and receive the two uppermost pivot rods 62, respectively, so as to allow links 68 and, consequently, steps 52 and arms 72, to become completely coplanar with frame 34. Supposing the tube used to make frame 34 has a $\frac{3}{4}''$ diameter, it is seen that the folded ladder can be stored in a shallow space, such as shown at 30A, FIG. 1, between refrigerator R and the kitchen counter 50. Hook rod 48 (see FIGS. 5, 6, 7) has end legs 80 which are outwardly bent to form aligned pivots 81 which engage holes 82 at the inner face of legs 60 or 64. End legs 80 are further bent at 83, so that when each leg 80 abuts against top frame leg 46, it clears the edge of kitchen counter 50 with the main leg of rod 48 resting on the counter top. A plastic sheath 84 protects counter 50 from dents. Rod 44 can be pivoted downward to an inoperative position nested within the frame 34. as shown in FIG. 7.

We will now refer to FIGS. 12 to 15, where the step panels 52 and associated end plates 56–58 are detailed. A pair of partial sleeves 86, depending from the underface of each step 52 and extending longitudinally spacedly therealong, are engaged by respective pivot rods 62 and 70, whereby relative displacement of the step is prevented.

Each end plate 56, 58 is similarly constructed; it is made of molded plastic and has rectangular plank 88, a smaller rectangular plank 90 centrally on the inner face thereof, and two still smaller blocks 92 at the opposite ends of the same inner face thereof spacedly from plank 90. A bore 94 is made in main plank 88 in between each block 92 and the central smaller plank 90 for engagement by a pivot rod 62 or 70. The blocks 92 cooperate with cross-sectionally L-shaped inturned flanges 96 that downwardly depend from the front and back longitudinal edges of each step panel 52 to firmly lock the end plates 56, 58 to the step panel 52. Smaller plank 90 fits the underside of step panel 52.

From the exterior faceof each plank 88, that is to say, on the side opposite that from which plank 90 and blocks 92 are protruding, project first and second sleeves 98 and 100, in registry with the two bores 94. First sleeve 98 is relatively long and is engaged by rod 62, whereas second sleeve 100 is shorter and engaged by rod 70. Sleeve 98 extends half-way within tubes 60 or 64, short of the exterior side thereof, and is thus invisible when the ladder is seen in side elevation, as in FIG. 2.

Sleeve 100 extends through link 68 and rod 70 projects slightly outwardly of arm 68 to be locked thereagainst by a lock cap 102, similar to lock cap 76A. Sleeves 98 and 100, being made of plastic, form frictionless pivot members in engagement within the metallic frame legs 60, 64 and link bars 68, respectively. A thicker annular spacer 104 around sleeve 98 spaces plank 88 from tube 60 or 64, and a thinner annular spacer 106 around cylinder 100 spaces plank 88 from link 68.

Hence, the width of panels 52 may be quite substantial for increased comfort and safety for users of the ladder 30, and yet the panels 52 will become coplanar with frame 34 when the ladder is folded.

It is envisioned to make frame 34 longer and add steps 52 and a U-shaped tubular frame 110 hinged at the top to frame 34 to constitute the stepladder 32 of FIGS. 16–20, which when, unfolded, is self-supporting. Frame 110 defines two main elongated legs 112–114, and a top base leg 116 interconnecting legs 112–112. Legs 112–114 are each pivotally connected proximate to base leg 116 to the exterior side of one main leg 60 or 64, respectively, of frame 34, proximate the top leg 46, by a double-headed bolt 118, spacedly through spacer sleeve 119, in such a fashion that leg 116 sweeps above leg 46 upon drawing legs 112–14 toward legs 60, 64. In fully retracted condition, frame 110 becomes coplanar with frame 34.

Of course, frame 110 may be reinforced by interconnecting legs 112–112 at their lower portion by a rigid bar 120, shown secured to their rear face (FIG. 17) to allow coplanar nesting of frames 34 and 110.

Two parts of pivotally interconnected lever arms 122 pivotally interconnect the interior face of an intermediate section of legs 112, 114 to the exterior face of the intermediate section of the registering legs 60, 64, respectively. Lever arms 122 form toggle levers which, when aligned, prevent accidental folding of frame 110 towards frame 34.

A tool supporting quadrangular, sheet metal panel 124 may also be conventionally mounted to the top front portion of the stepladder 32. More precisely, panel 124, including side and outer edgewise bent flanges 126,128, with the side flanges 26 projecting rearwardly of the rear edge of the panel 124 to define rear ears 126A, is pivoted by lock pins 130 engaging the ears 26A and the upper portion of the exterior face of legs 112,114, in horizontal register with rod 70A. IN extended condition, panel 124 is horizontal (its rear edge abuts against side legs 112–114), whereas in retracted condition, it has pivoted upwardly, clearing legs 112–114 to abut against frames 34 and 110 (slightly outwardly of their common plane), whereby side flanges 126 frictionally contact the exterior face of legs 112–114 and front flange 128 snaps over leg 116.

Figure 17:
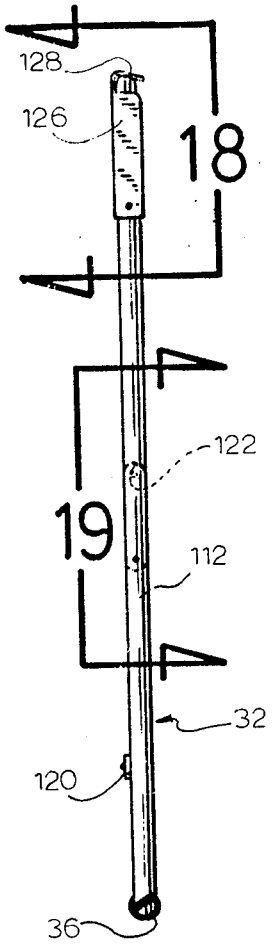
FIG. 17 is a side elevation of the stepladder of FIG. 16, but in its retracted storage condition.
Figure 18:
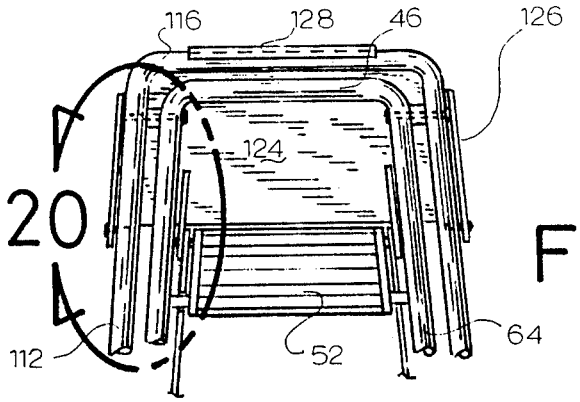
FIGS. 18 and 19 are sections taken along lines 18—18 and 19—19, respectively, of FIG. 17.
Figure 19:
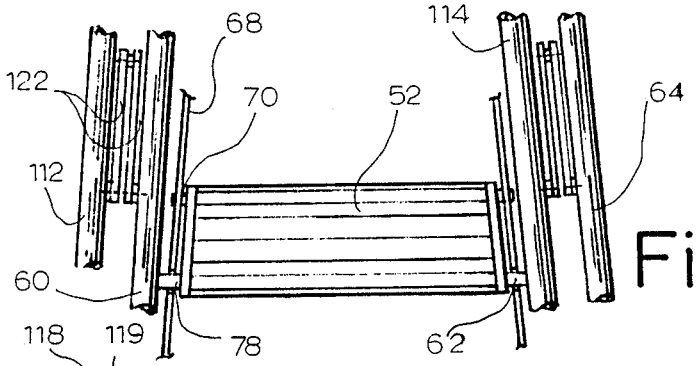
Figure 20:
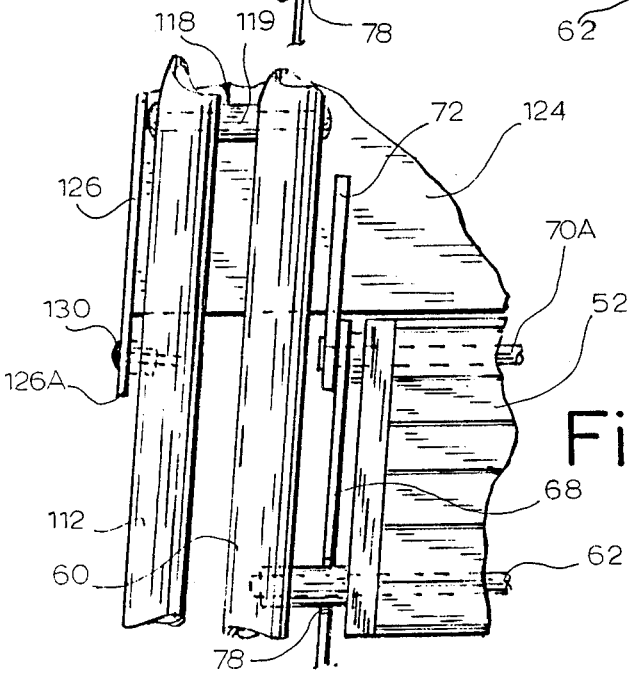
FIG. 20 is an enlarged view taken within the area circumscribed by circle 20 in FIG. 18.

When folded, as shown in FIG. 17, step ladder 32 is not any thicker than frame 34, except for thin bar 120 and thin panel 124. Therefore, step ladder 32 can be stored in a shallow space.

What I claim is:

1. A ladder comprising a main planar frame defining a transverse top leg, two side legs, at least two rectangular steps each defining a top flat surface, a front and a rear face, and two opposite end faces, each of said steps pivotally connected at its front corners by a first pivot member to the interior face of said side legs in lengthwisely-spaced fashion; said steps being pivotable between said side legs, and the thickness of said steps at the most equal to the thickness of said side legs; a pair of rigid links pivotally interconnecting the rear corners of said steps by second pivot members, said side legs, steps and links defining a deformable parallelogram with said steps pivotable between an operative position, in which the step top surfaces are horizontal, and a folded position, in which said steps, said pivot members and said links are nested within said frame and coplanar therewith for storage of the ladder, retainer arms for retaining said steps in horizontal position pivoted by said pivot members to the rear corners of the topmost one of said steps and by third pivot members to the interior face of said side legs at points spaced above said topmost step, each retainer arm having a lost motion connection at one of said second and third pivot members, each step including a main part made of extruded metal and two end parts made of molded plastic and fitted to the ends of said main part, each end part including outwardly protruding first and second sleeves rotatably engaging the adjacent side leg and link, respectively, and first and second rods extending underneath said main part and through said first and second sleeves, respectively, of each end part, said first and second rods and associated first and second sleeves forming said first and second pivot members respectively.

2. A ladder as in claim 1, wherein said lost motion connection includes a longitudinal central slot made in the top portion of each retainer arm and slidingly engaged by said third pivot member which projects inwardly from the interior face of the corresponding one of said side legs.

3. A ladder as in claim 1, wherein said links are flat strips having notches receiving said first pivot members in said folded position.

4. A ladder as claimed in claim 1, further including an inverted U-shaped hook rod having a straight bight portion spanning the distance between the side legs of said main frame, side legs outwardly bent at their outer ends to form aligned pivots, said pivots engaging holes made in the interior face of the main frame side legs at the top thereof, the side legs of said hook rod bend intermediate their ends, said hook rod pivotable between an inoperative position in which it is nested within said main frame and an operative position in which said side legs of said hook rod abut said transverse top leg of said main frame, and the bight portion of said hook rod protrudes from the plane of said main frame to rest on a horizontal surface near an edge thereof.

5. A ladder comprising a main planar frame defining a transverse top leg, two side legs, at least two rectangular steps each defining a top flat surface, a front and a rear face, and two opposite end faces, each of said steps pivotally connected at its front corners by a first pivot member to the interior face of said side legs in lengthwisely-spaced fashion; said steps being pivotable between said side legs, and the thickness of said steps at the most equal to the thickness of said side legs; a pair of rigid links pivotally interconnecting the rear corners of said steps by second pivot members, said side legs, steps and links defining a deformable parallelogram with said steps pivotable between an operative position, in which the step top surfaces are horizontal, and a folded position, in which said steps, said pivot members and said links are nested within said frame and coplanar therewith for storage of the ladder, retainer arms for retaining said steps in horizontal position pivoted by said second pivot members to the rear corners of the topmost one of said steps and by third pivot members to the interior face of said side elgs at points spaced above said topmost step, each retainer arm having a lost motion connection at one one of said second and third pivot members, an inverted U-shaped planar frame defining a top base leg and two side legs hinged at their upper end portions to the exterior face of the upper ends of the first-mentioned frame side legs, said U-shaped frame pivotable between a folded position coplanar with the first-mentioned frame, and an operative position at an acute angle relative to said first-mentioned frame to form a self-standing stepladder, and toggle lever arms pivoted to the side legs of the two frames for releasable retaining said frames in operative position, said arms foldable between the side legs of said two frames in said folded position.

6. A ladder as in claim 5, further including a thin quadrangular tool-supporting board, defining front, rear and side edges, and a top surface, and including front and side flanges extending edgewise of its front and side edges, respectively; said side flanges extending past the rear edge of said board to define rear ears that are hinged to the exterior face of said U-shaped frame side legs; said board pivotable between a first position, in which its top surface is horizontal and its rear edge abuts against said U-shaped frame side legs, and a second retracted position, in which the board top surface abuts against the last-mentioned side legs, said side flanges then extending exteriorly of the upper portion of these latter side legs, and said front flange extending exteriorly of and frictionally engaging the top base leg of said inverted U-shaped frame.

* * * * *